US007185450B2

(12) United States Patent
Lin et al.

(10) Patent No.: US 7,185,450 B2
(45) Date of Patent: Mar. 6, 2007

(54) PRESSING IRON

(75) Inventors: Fang-Chuan Lin, Taipei (TW); Chih-Jung Pan, Taipei (TW); Shih-Wei Tung, Taipei (TW); Jr-Ren Ji, Taipei (TW); Chi-Yu Liau, Taipei (TW)

(73) Assignee: Tsann Kuen Enterprise Co., Ltd., Taipei (TW)

( * ) Notice: Subject to any disclaimer, the term of this patent is extended or adjusted under 35 U.S.C. 154(b) by 0 days.

(21) Appl. No.: 11/334,173

(22) Filed: Jan. 18, 2006

(65) Prior Publication Data

US 2006/0179692 A1 Aug. 17, 2006

(30) Foreign Application Priority Data

Jan. 31, 2005 (CN) ..... 2005 1 0042444

(51) Int. Cl.
*D06F 75/26* (2006.01)
*D06F 75/06* (2006.01)

(52) U.S. Cl. ..... 38/89

(58) Field of Classification Search ..... 38/74, 38/81, 88, 89, 90, 91, 92, 93, 95; 219/245
See application file for complete search history.

(56) References Cited

U.S. PATENT DOCUMENTS

| | | | | |
|---|---|---|---|---|
| 1,723,561 | A * | 8/1929 | Lavoie | 38/74 |
| 2,186,930 | A * | 1/1940 | Scharf | 38/75 |
| 2,362,590 | A * | 11/1944 | Smith | 38/75 |
| 2,371,257 | A * | 3/1945 | Olving | 38/89 |
| 2,373,345 | A * | 4/1945 | Scharf | 38/89 |
| 2,384,644 | A * | 9/1945 | Schreyer | 38/79 |
| 5,210,394 | A * | 5/1993 | Kerremans | 219/245 |

* cited by examiner

*Primary Examiner*—Ismael Izaguirre
(74) *Attorney, Agent, or Firm*—Ladas & Parry LLP

(57) ABSTRACT

A pressing iron includes a soleplate which has upwardly and downwardly facing major surfaces opposite to each other. A shell includes a peripheral wall which extends upwardly from a periphery of the soleplate to terminate at an upper peripheral edge, and which defines an air passageway that extends longitudinally. The peripheral wall is formed with a vent port disposed downstream of the air passageway. A ventilation facilitating mechanism is disposed upstream of the vent port to increase flow of air through the air passageway and out of the vent port so as to accelerate a cooling process of the flowing air that draws residual heat off the soleplate after the pressing iron is turned off.

9 Claims, 4 Drawing Sheets

PRESSING IRON

CROSS-REFERENCE TO RELATED APPLICATION

This application claims priority of Chinese patent Application No. 200510042444.2, filed on Jan. 31, 2005.

BACKGROUND OF THE INVENTION

1. Field of the Invention

This invention relates to a pressing iron, more particularly to a pressing iron with a heat-dissipating assembly to accelerate cooling of a soleplate of the iron after the iron is turned off.

2. Description of the Related Art

A conventional electric pressing iron generally includes a soleplate mounted on a bottom portion of a shell, and a heating device and a steam generating device disposed within the shell to heat the soleplate and generate steam for ironing purposes. However, the conventional pressing iron lacks means for rapidly dissipating heat off the soleplate after the iron is turned off. In general, the conventional pressing iron is supported by a heel rest in a vertical resting position to cool off, which usually takes a long time. The residual heat in the soleplate would take time to dissipate and a user could be burned before the soleplate has cooled sufficiently.

SUMMARY OF THE INVENTION

The object of the present invention is to provide a pressing iron which can rapidly dissipate residual heat in a soleplate after the iron is turned off.

According to this invention, the pressing iron includes a soleplate which has upwardly and downwardly facing major surfaces opposite to each other in an upright direction. A shell includes a peripheral wall which extends from a periphery of the soleplate in the upright direction, which terminates at an upper peripheral edge, and which defines an air passageway that extends in a first direction transverse to the upright direction. The peripheral wall is formed with a vent port disposed downstream of the air passageway. A ventilation facilitating mechanism is disposed upstream of the vent port to increase flow of air through the air passageway and out of the vent port so as to accelerate a cooling process of the flowing air that carries residual heat away from the soleplate after the pressing iron is turned off.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
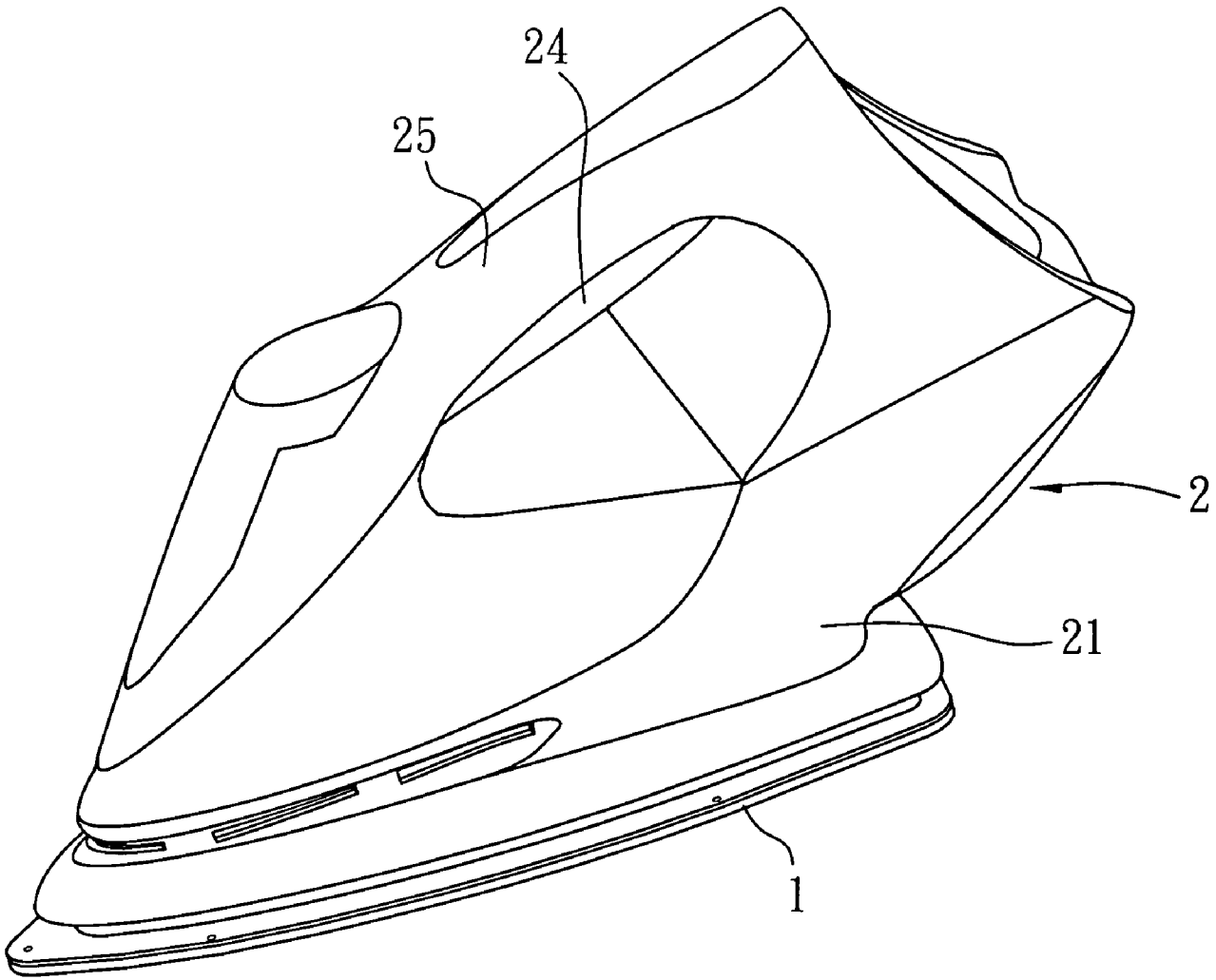
FIG. 1 is a perspective view of the preferred embodiment of a pressing iron according to this invention.
Figure 2:
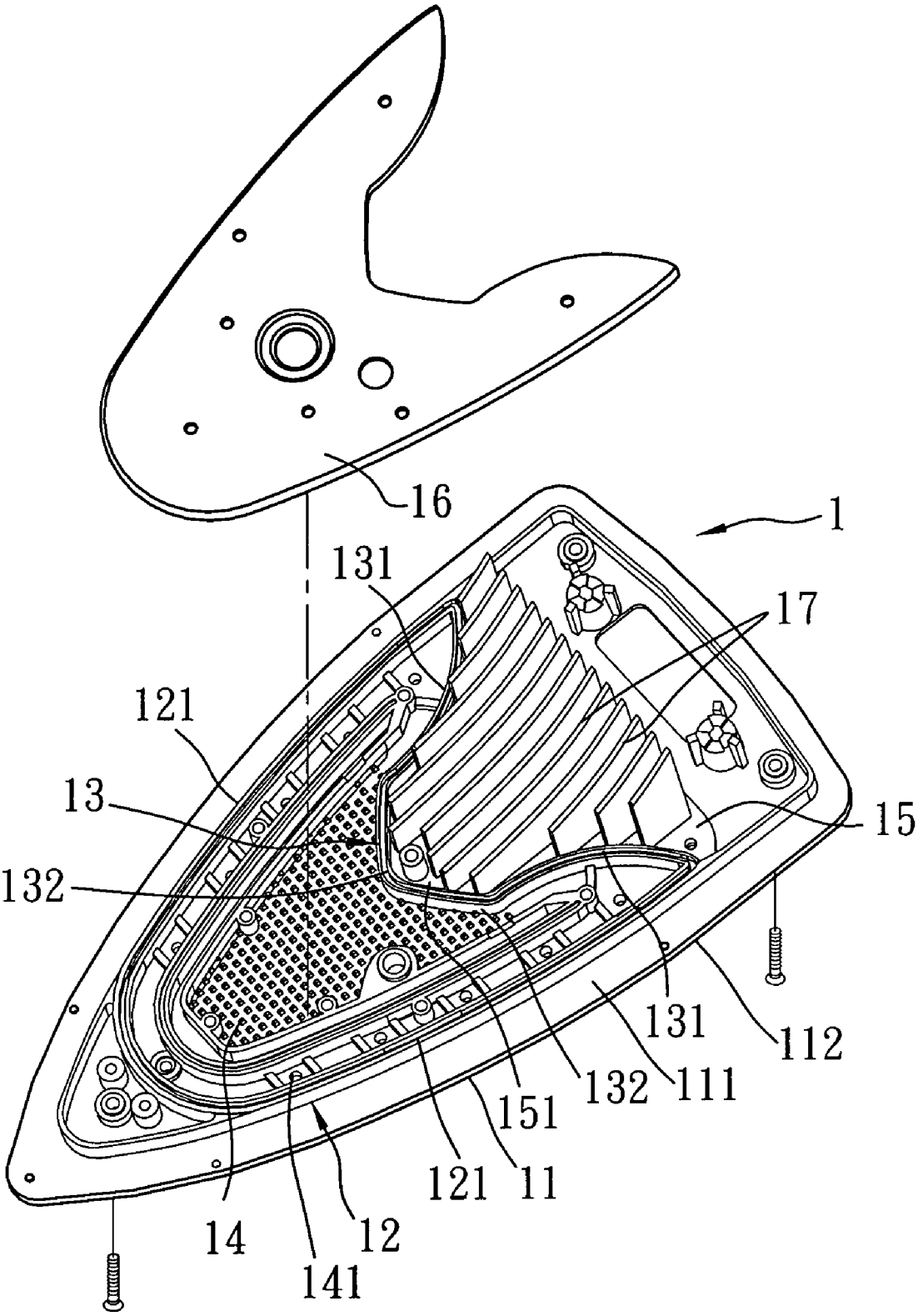
FIG. 2 is an exploded perspective view of a portion of the preferred embodiment.
Figure 3:
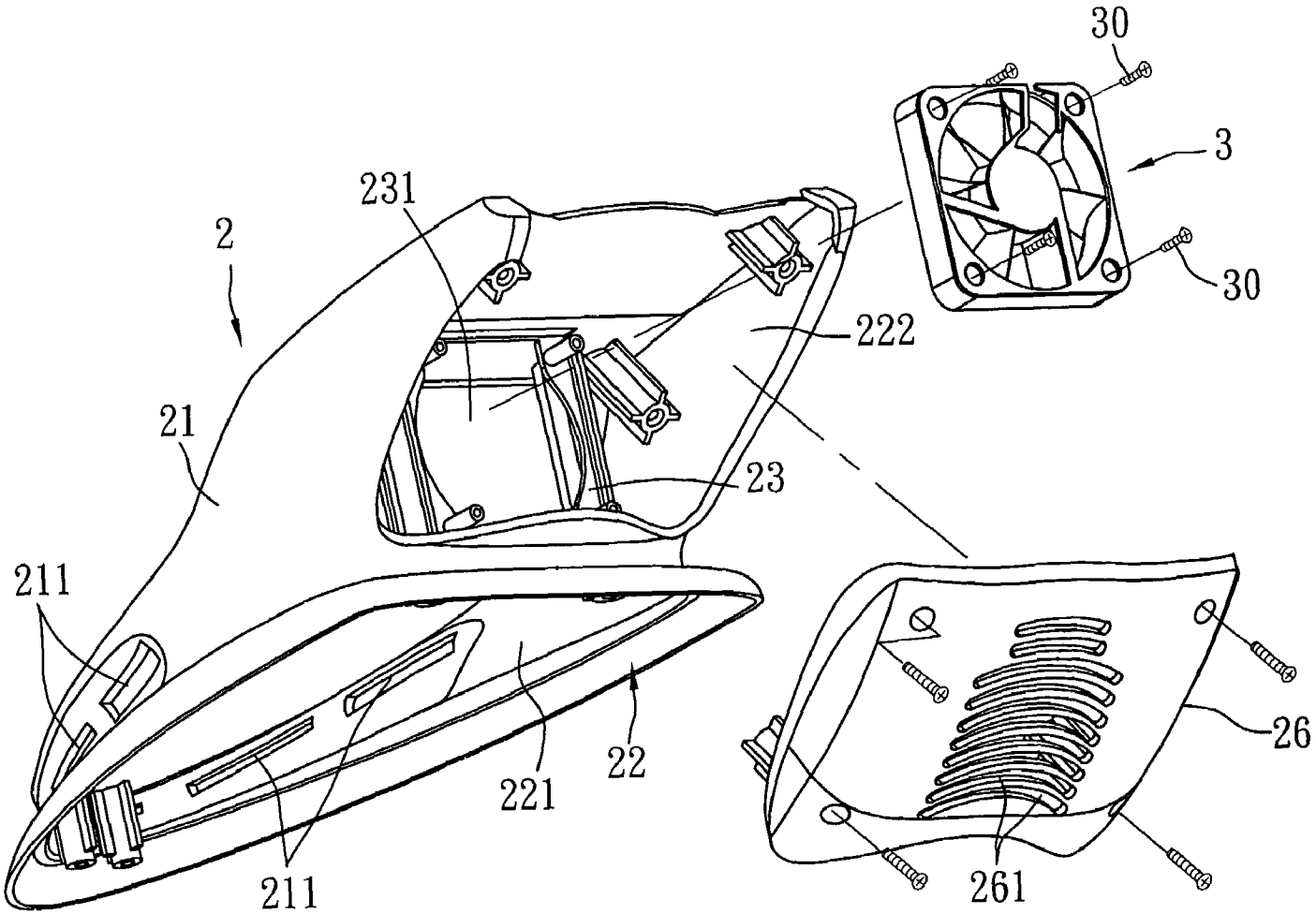
FIG. 3 is an exploded perspective view of the preferred embodiment.
Figure 4:
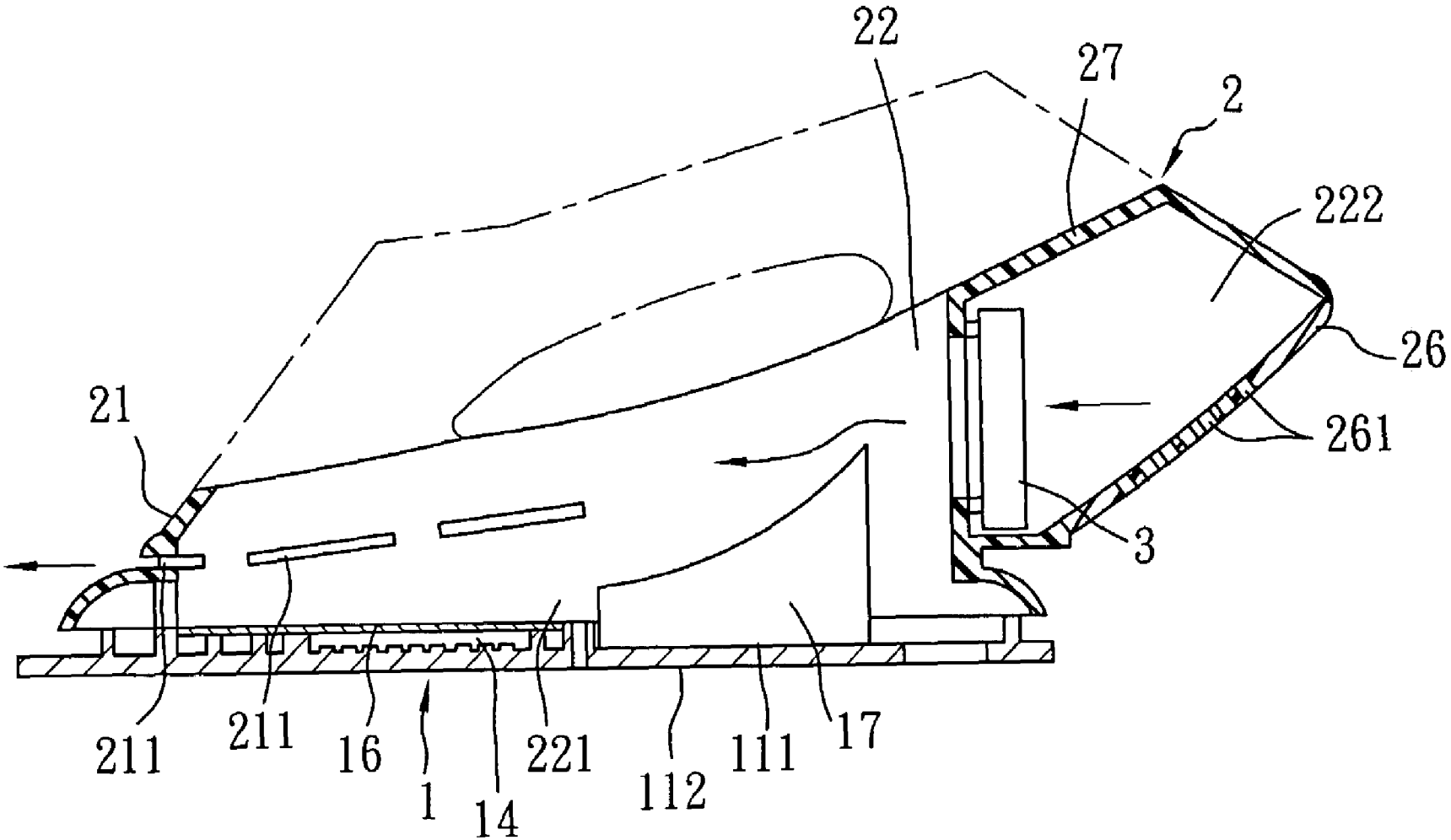
FIG. 4 is a sectional view of the preferred embodiment.

Referring to FIGS. 1 to 4, the preferred embodiment of a pressing iron according to the present invention is shown to comprise a soleplate 1, a shell 2, and a heat-dissipating assembly.

The soleplate 1 has a periphery 11 surrounding a centerline normal to the soleplate 1, upwardly and downwardly facing major surfaces 111, 112 opposite to each other in an upright direction parallel to the centerline, a confining wall 12 extending upwardly in an upright direction from the upwardly facing major surface 111, a partition wall 13 which extends in the upright direction from the upwardly facing major surface 111 and which interconnects two flanking segments 121 of the confining wall 12 to cooperatively define on the soleplate 1 a front steam-forming region 14 and a rear heat-dissipating region 15 opposite to each other in a first direction, i.e. a longitudinal direction transverse to the upright direction, and a heating element (not shown) disposed at the front steam-forming region 14 to heat the sole plate 1 and to generate steam. A cover plate 16 is mounted on the soleplate 1 to cover the front steam-forming region 14. Moreover, the partition wall 13 includes two flanking wall segments 131 connected respectively to the flanking segments 121 of the confining wall 12, and a middle wall segment 132 interposed between the flanking wall segments 131 so as to form a front narrow area 151 in the rear heat-dissipating region 15. The front steam-forming region 14 has a plurality of steam vents 141 which extend through the downwardly facing major surface 112 for downward ejection of the steam.

The shell 2 includes a peripheral wall 21 which extends from the periphery 11 of the soleplate 1 in the upright direction and which terminates at an upper peripheral edge that surrounds the centerline, a handle mounting wall 27 which extends from the upper peripheral edge towards the centerline, and which confronts and which cooperates with the upwardly facing major surface 111 to define an air passageway 22 that extends in the longitudinal direction, and a handle 25 which is mounted on and cooperates with the handle mounting wall 27 to define a grip hole 24. The peripheral wall 21 has a wind shield 26 which is detachably mounted on a rear portion thereof, and which is formed with an intake port in the form of a plurality of intake holes 261 disposed upstream of the air passageway 22. The wind shield 26 may also be formed integrally with the rear portion of the peripheral wall 21. A mounting frame 23 extends in the upright direction, and is interposed between the handle mounting wall 27 and the upwardly facing major surface 111 to divide the air passageway 22 into front and rear ventilation regions 221, 222. The mounting frame 23 has a hole 231 communicating the front and rear ventilation regions 221, 222. Moreover, the peripheral wall 21 has a vent port in the form of a plurality of vent holes 211 surrounding the front steam-forming region 14 and disposed downstream of the front ventilation region 221 of the air passageway 22.

The heat dissipating assembly includes a plurality of heat dissipating fins 17 which are mounted on and which extend from the rear heat-dissipating region 15 in the upright direction, and which are displaced from one another in a second direction transverse to both the upright direction and the longitudinal direction. Each of the fins 17 have front and rear ends opposite to each other in the longitudinal direction, and increases in height from the front end to the rear end. The rear ends of the fins 17 are flush with one another. Furthermore, the middle ones of the fins 17 are longer in the longitudinal direction than the flanking ones of the fins 17.

The heat dissipating assembly further includes a ventilation facilitating mechanism which is disposed downstream of the intake holes 261 and upstream of the fins 17. The ventilation facilitating mechanism includes a plurality of holes which are formed in the peripheral wall 21 and which are aligned with the intake holes 261, respectively, and a fan 3 which is secured on the mounting frame 23 by means of screw fasteners 30 and which confronts the intake holes 261. Therefore, when the fan 3 is actuated after the pressing iron is turned off, the flow rate of air drawn into the air passageway 22 from the intake holes 261 and out of the vent holes 211 can be increased so as to accelerate a cooling process of the flowing air that carries residual heat away from the soleplate 1. Thus, the residual heat of the soleplate 1 can be dissipated quickly so as to protect the user and others against damage and injury when the pressing iron is placed in a vertical resting position.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A pressing iron comprising:

a soleplate which has a periphery surrounding a centerline normal to said soleplate, and upwardly and downwardly facing major surfaces opposite to each other in an upright direction parallel to the centerline;

a shell including a peripheral wall which extends from said periphery of said soleplate in the upright direction, which terminates at an upper peripheral edge that surrounds the centerline, and which defines an air passageway that extends in a first direction transverse to the upright direction, said peripheral wall being formed with a vent port disposed downstream of said air passageway; and a ventilation facilitating mechanism disposed upstream of said vent port to increase flow of air through said air passageway and out of said vent port so as to accelerate a cooling process of the flowing air that carries residual heat away from said soleplate after said pressing iron is turned off;

said shell having an intake port disposed upstream of said air passageway and said ventilation facilitating mechanism such that air enters said air passageway from said intake port;

said ventilation facilitating mechanism including a fan which confronts said intake port so as to draw air into said air passageway through said intake port;

the first direction being a longitudinal direction;

said upwardly facing major surface including a front steam-forming region and a rear heat-dissipating region opposite to each other in the longitudinal direction and proximate to said vent port and said intake port, respectively, said front steam-forming region having a plurality of steam vents which extend through said downwardly facing major surface for downward ejection of steam, said fan being mounted on said rear heat-dissipating region.

2. The pressing iron of claim 1, wherein said shell includes a handle mounting wall which extends from said upper peripheral edge towards the centerline, and which confronts and which incorporates with said upwardly facing major surface to define said air passageway, and a mounting frame which extends in the upright direction and which is interposed between said handle mounting wall and said upwardly facing major surface for mounting said fan thereon.

3. The pressing iron of claim 1, wherein said soleplate has a partition wall which extends from said upwardly facing major surface in the upright direction and which divides said upwardly facing major surface into said front steam-forming region and said rear heat-dissipating region.

4. A pressing iron comprising:

a soleplate which has a periphery surrounding a centerline normal to said soleplate, and upwardly and downwardly facing major surfaces opposite to each other in an upright direction parallel to the centerline;

a shell including a peripheral wall which extends from said periphery of said soleplate in the upright direction, which terminates at an upper peripheral edge that surrounds the centerline, and which defines an air passageway that extends in a first direction transverse to the upright direction, said peripheral wall being formed with a vent port disposed downstream of said air passageway; and a ventilation facilitating mechanism disposed upstream of said vent port to increase flow of air through said air passageway and out of said vent port so as to accelerate a cooling process of the flowing air that carries residual heat away from said soleplate after said pressing iron is turned off;

wherein the first direction is a longitudinal direction, said pressing iron further comprising a plurality of heat dissipating fins which are mounted on and which extend from said upwardly facing major surface in the upright direction, and which are displaced from one another in a second direction transverse to both the upright direction and the longitudinal direction.

5. The pressing iron of claim 4, wherein each of said fins has front and rear ends opposite to each other in the longitudinal direction, and increases in height from said front end to said rear end.

6. A pressing iron comprising:

a soleplate which has a periphery surrounding a centerline normal to said soleplate, and upwardly and downwardly facing major surfaces opposite to each other in an upright direction parallel to the centerline;

a shell including a peripheral wall which extends from said periphery of said soleplate in the upright direction, which terminates at an upper peripheral edge that surrounds the centerline, and which defines an air passageway that extends in a first direction transverse to the upright direction, said peripheral wall being formed with a vent port disposed downstream of said air passageway;

a ventilation facilitating mechanism disposed upstream of said vent port to increase flow of air through said air passageway and out of said vent port so as to accelerate a cooling process of the flowing air that carries residual heat away from said soleplate after said pressing iron is turned off; and a plurality of heat dissipating fins which are mounted on and which extend from said upwardly facing major surface in the upright direction, and which are displaced from one another in a second direction transverse to both the upright direction and the longitudinal direction, said fins being disposed downstream of said fan;

wherein said shell has an intake port disposed upstream of said air passageway and said ventilation facilitating mechanism such that air enters said air passageway from said intake port; and wherein said ventilation facilitating mechanism includes a fan which confronts said intake port so as to draw air into said air passageway through said intake port.

7. The pressing iron of claim 6, wherein a middle one of said fins is longer in the longitudinal direction than flanking ones of said fins.

8. A pressing iron comprising:

a soleplate having upwardly and downwardly facing major surfaces opposite to each other;

a shell including a peripheral wall which extends from said soleplate to define an accommodation chamber therein, and which has a vent port formed therein; and at least one dissipating fin which is mounted on and extending from said upwardly facing major surface and which is received in said accommodation chamber;

wherein said soleplate has a partition wall which extends from said upwardly facing major surface and which divides said upwardly facing major surface into a front steam-forming region and a rear heat-dissipating region, said dissipating fin being disposed on said rear heat-dissipating region.

9. The pressing iron of claim 8 wherein said dissipating fin has front and rear ends opposite to each other, and increases in height from said front end to said rear end.

* * * * *